US007721360B2

(12) United States Patent
Bernardi et al.

(10) Patent No.: US 7,721,360 B2
(45) Date of Patent: May 25, 2010

(54) SWIMMING POOL, SPA, OR COMBINATION SWIMMING POOL AND SPA, HEATED WITH A HEAT PUMP WITH A HEAT EXCHANGER

(75) Inventors: William P. Bernardi, Ligonier, PA (US); David A. Greene, Greensburg, PA (US)

(73) Assignee: United States Thermoamp Inc., Latrobe, PA (US)

( * ) Notice: Subject to any disclaimer, the term of this patent is extended or adjusted under 35 U.S.C. 154(b) by 1027 days.

(21) Appl. No.: 11/445,710

(22) Filed: Jun. 2, 2006

(65) Prior Publication Data

US 2007/0006373 A1 Jan. 11, 2007

(51) Int. Cl.
*E04H 4/00* (2006.01)

(52) U.S. Cl. ..... 4/493

(58) Field of Classification Search ..... 4/488, 4/493, 507, 509

See application file for complete search history.

(56) References Cited

U.S. PATENT DOCUMENTS 3,837,016 A * 9/1974 Schindler et al. ..... 4/489
5,415,221 A * 5/1995 Zakryk ..... 165/283
6,109,050 A * 8/2000 Zakryk ..... 62/238.6

* cited by examiner

*Primary Examiner*—Huyen Le
(74) *Attorney, Agent, or Firm*—Nils H. Ljungman & Associates

(57) ABSTRACT

A swimming pool, Spa or combination of a swimming pool or spa is heated with a heat pump and a heat exchanger. The heat exchanger comprises a water input, a water output, a heating agent input, a heating agent output, an inner coil and an outer coil being disposed about the outer periphery of the inner coil; and a separator device being configured and disposed to separate the coils in order to minimize vibrating and rubbing against each other. The separator device comprises a first separator device portion having two rounded shoulder portions configured to permit the separator device to be rotated into position between the inner coil and the outer coil, a middle portion comprising two substantially C-shaped curves, which substantially C-shaped curves form a dog bone-shape, and a second separator device portion comprising two rounded configured to be turned or twisted upon assembly of the heat exchanger.

20 Claims, 12 Drawing Sheets

Fig. 1
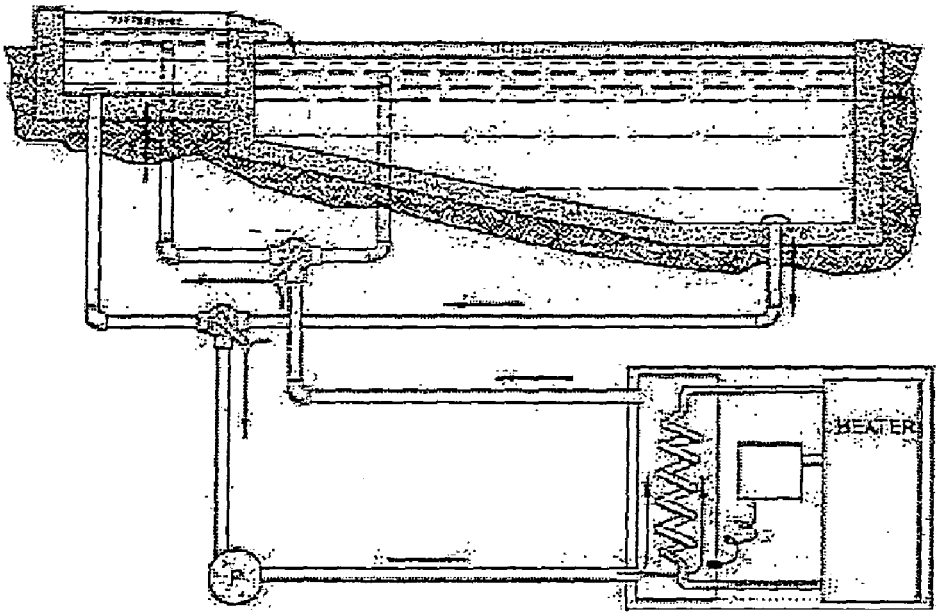
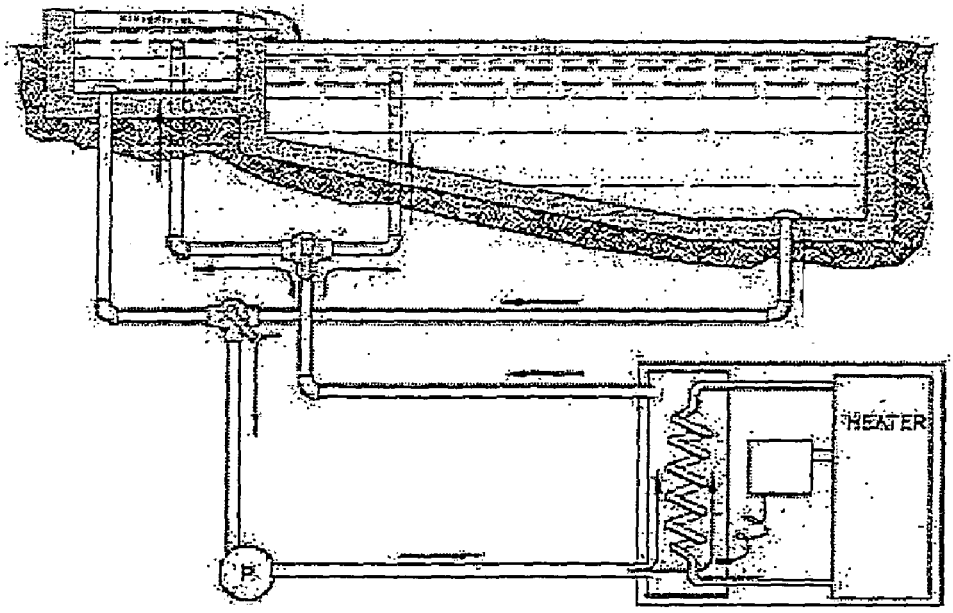
Fig. 1A

Fig. 4
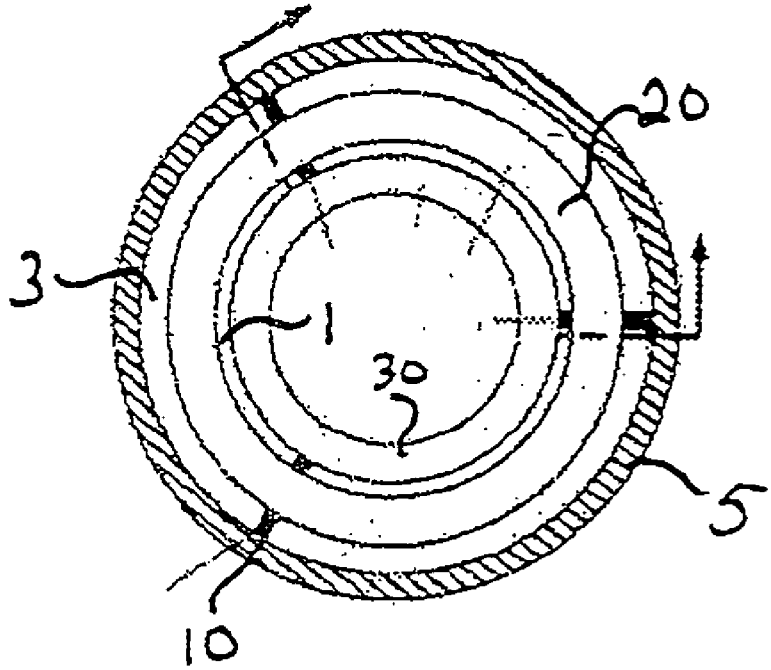
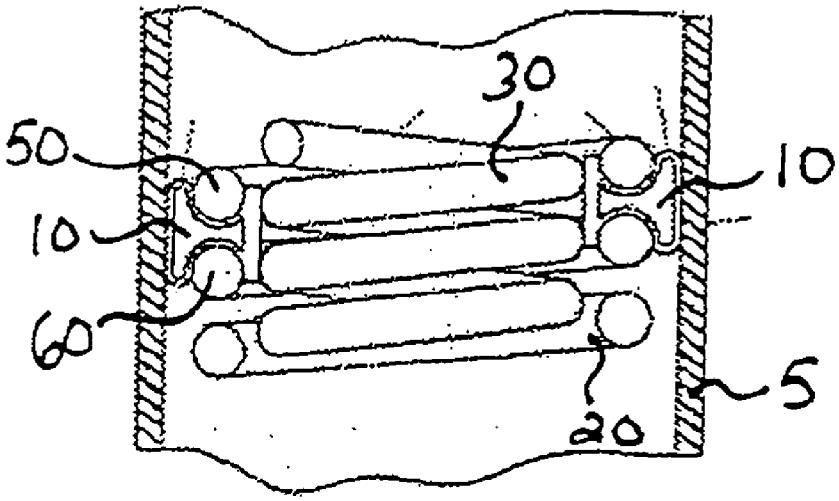
Fig. 4A

Fig. 5A
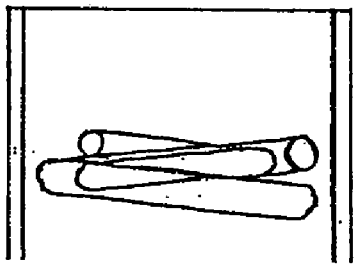
Fig. 5B
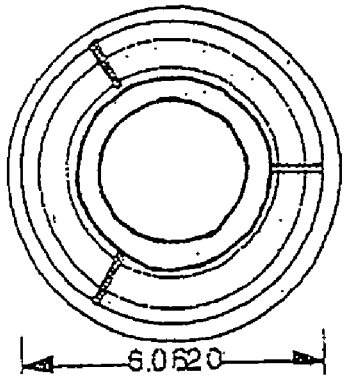
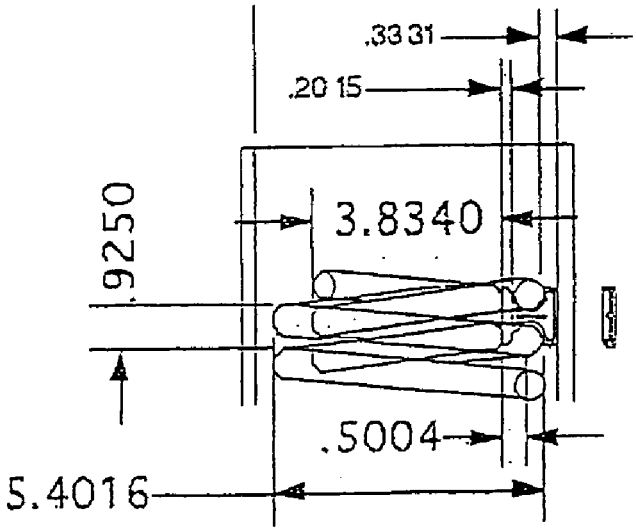
Fig. 5C

Fig. 10
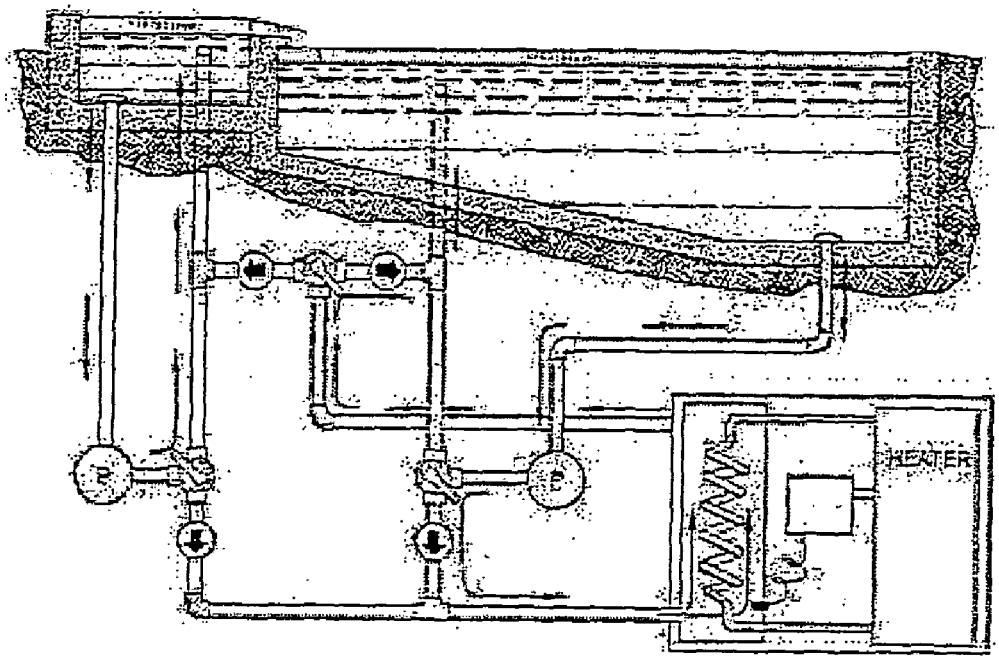
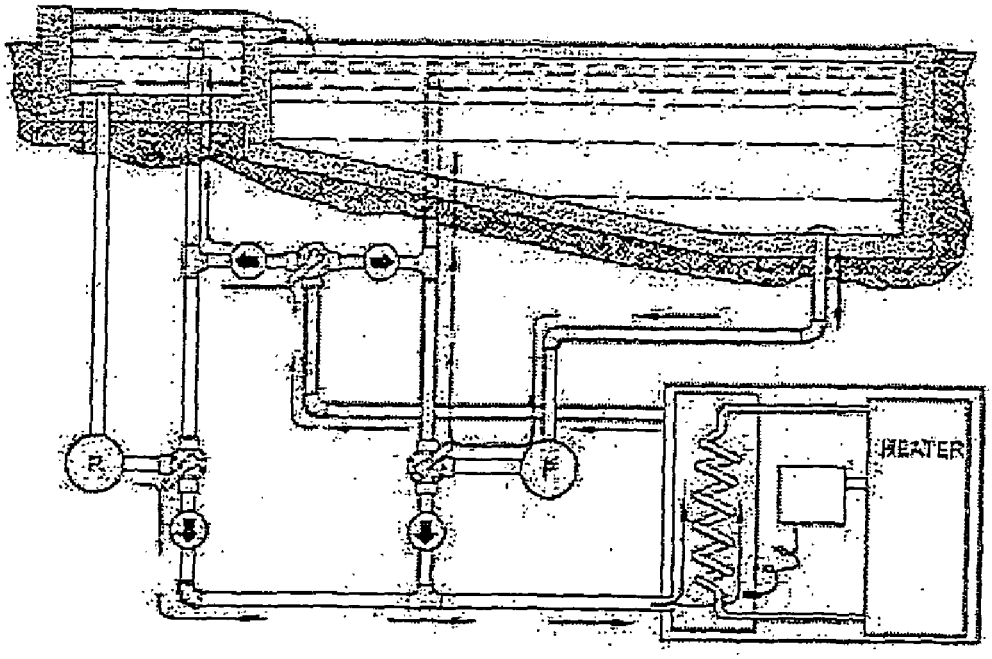
Fig. 10A

Fig. 11
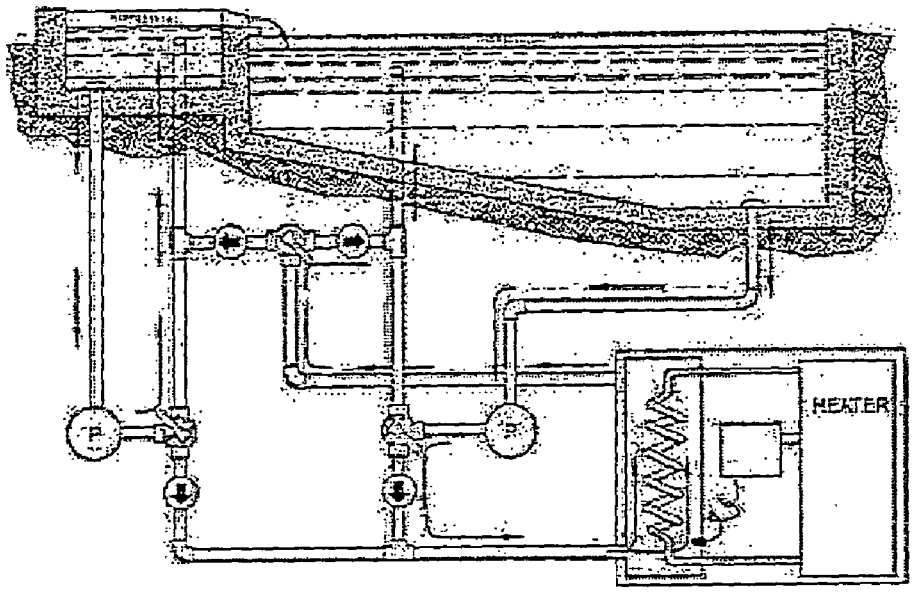
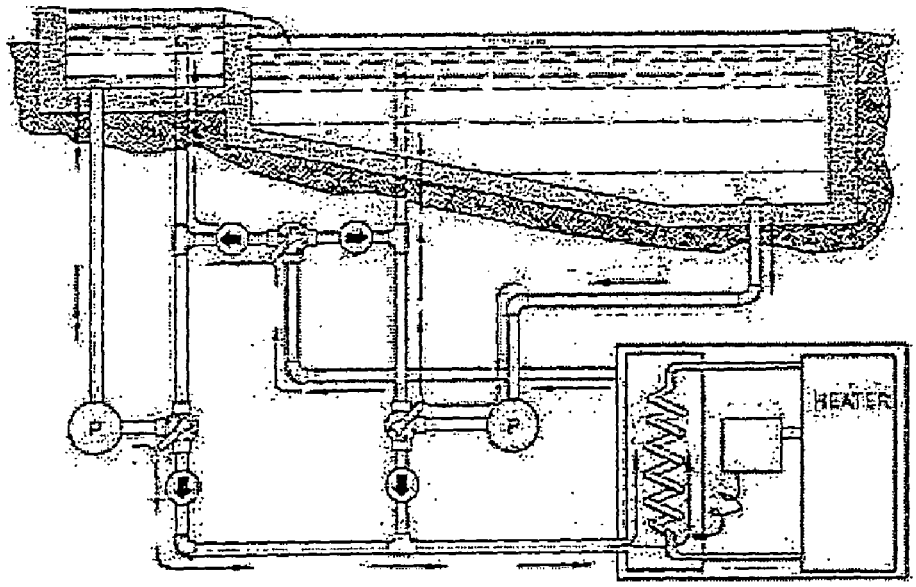
Fig. 11A

SWIMMING POOL, SPA, OR COMBINATION SWIMMING POOL AND SPA, HEATED WITH A HEAT PUMP WITH A HEAT EXCHANGER

BACKGROUND

1. Technical Field

The present application relates to a swimming pool, spa, or combination swimming pool and spa, heated with a heat pump with a heat exchanger.

2. Background Information

Swimming and relaxing in a pool or spa are extremely popular pastimes in the United States. Swimming pools, both public and private, offer people relief from the heat while also offering an opportunity for social gatherings and fun for adults and children. Several types of swimming pools and spas exist, including in-ground pools, above-ground pools, wading pools for small children, spas, hot tubs, and whirlpools. Swimming pools and spas can be located outdoors, as in the back yard of a person's house or at a public community pool, or indoors, as in at a hotel pool or a private indoor pool. Further, swimming pools can be found in all different sizes, ranging from a small, above-ground pool that is only a few feet in depth, to a large, Olympic-sized pool, designed for competitive swimming or diving. Spas, hot tubs, and whirlpools can also be found in different sizes.

Many pools, especially indoor pools, are typically heated for the comfort of swimmers. Spas, hot tubs, and whirlpools are also heated for the comfort of users, as well as for therapeutic purposes for users. Since most indoor pools, including hotel pools and community pools, remain open to users year-round, and since most spas also remain open year-round, it is necessary for the heat exchanger to be able to constantly work with as little maintenance or repairs as possible.

Due to the necessity of swimming pool pumps to move or turn over the entire volume of pool water through the pool filter several times a day, any full flow heat exchanger must handle a high flow rate and thus high velocity of the water flowing through the heat exchanger. This high velocity poses several problems, as the high velocity could cause vibration of the coils which naturally have a spring resonant frequency and are prone to vibration. The vibration could be in the hundreds or even thousands of cycles per second, and over a short amount of time, the vibrations could rub a hole in the wall of the thin heat exchanger tube if the wall of the thin heat exchanger tube is allowed to contact either the adjacent tube wraps or the outer shell.

Due to the corrosive chlorine and pool sanitation chemicals used to treat swimming pools, including inorganic chlorinating agents such as calcium hypochlorite, lithium hypochlorite, sodium hypochlorite, and organic chlorinating agents such as trichloroisocyanuric acid, potassium dichloroisocyanurate, or sodium dichlorocyanurate as anhydrous or dihydrate forms, the tube material may comprise an alloy such as titanium or any high alloy stainless steels that can withstand these chemicals without fouling or corrosion, and to ensure continued service over time. The above alloys are typically costly materials, and thus to maximize heat transfer and to minimize expense, very thin wall tubing is commonly used in swimming pool and spa heat exchangers. Alloys such as these develop a hard film oxide coating, which helps to prevent the corrosion caused by chlorine and other pool sanitation chemicals. Because of this very abrasive coating, extra care must be taken to prevent tube damage caused by the wall tubing rubbing together if the wall tubing is allowed to touch and vibrate.

In addition, the tube wraps must be centered for optimum heat transfer uniform velocity. Therefore, a method and device for holding the tube wraps apart and centering the tube wraps would be beneficial to minimize damage and promote optimal operation.

Various methods of holding tube wraps apart and centering tube wraps have been used, including injecting silicone rubber between the tubes at intervals to freeze them in place, spreading the wraps apart and inserting rubber or plastic bumpers between the tubes, or placing long strips of material axially between the inner and outer coils during or after they are formed. All of these methods, however, have the disadvantage of requiring substantial care and time to assemble, and, in some cases, baking or curing time to set up the material before the heat exchanger coils can be used. Further, many of these methods are also costly to manufacture.

OBJECT OR OBJECTS

To provide a method and device for holding apart the tube wraps of a heat exchanger of a swimming pool or spa and to center the tube wraps of a heat exchanger of a swimming pool or spa.

SUMMARY

The coil key separator device shown in the detailed drawings is a simple, uniquely shaped device invented to solve the above problems with heat exchangers for swimming pools and spas. The coil key separator device offers the following advantages in a swimming pool or spa heat pump tube in shell heat exchanger:

1. The unique curved shape allows easy horizontal insertion between two tube wraps. When turned or twisted in a clockwise or counter clockwise direction, the coil key separator device spans at least one or several inner tube wraps, and also snap twists to lock itself and the outer tube the coil key separator device is inserted through into place.

2. The minimum profile of the coil key separator device also offers very little resistance to pool water flow in the normal axial direction.

3. The coil key separator device is quickly and easily inserted between tube wraps in a few seconds, and, with a quick 90 degree turn, the coil key separator device snaps into place, locking the tubes together.

4. The coil key separator device can be sized to exactly space the tubes as desired between each other and inside the outer shell. The coil key separator device can be any desired size, depending on the size of the heat exchanger in which it is used.

5. Three coil key separator devices placed radially 120 degrees apart will lock the tube position in all three axes, thus minimizing or essentially eliminating vibration and rubbing between the tube wraps.

6. The coil key separator device can be injection molded very inexpensively from softer or harder suitable plastic material. This material will withstand corrosion from pool or spa chemicals, as well as minimize friction between itself and the tubes or outer heat exchanger housing.

7. Three coil key separator devices inserted at the proper axial intervals along any length of tube coils will dampen essentially all vibration no matter how long the heat exchanger is.

8. The coil key separator device renders the heat exchanger coils immediately ready for the next assembly operation, and can be installed and used without delay.

The above-discussed embodiments of the present invention will be described further hereinbelow. When the word "invention" or "embodiment of the invention" is used in this specification, the word "invention" or "embodiment of the invention" includes "inventions" or "embodiments of the invention", that is the plural of "invention" or "embodiment of the invention". By stating "invention" or "embodiment of the invention", the Applicant does not in any way admit that the present application does not include more than one patentably and non-obviously distinct invention, and maintains that this application may include more than one patentably and non-obviously distinct invention. The Applicant hereby asserts that the disclosure of this application may include more than one invention, and, in the event that there is more than one invention, that these inventions may be patentable and non-obvious one with respect to the other.

BRIEF DESCRIPTION OF THE DRAWINGS

FIGS. 1 and 1A show two possible embodiments of a pool and a heating system for a pool;

FIG. 4 shows a top view of several coil key separator devices installed between the coils of a heat exchanger for a swimming pool or spa;

FIG. 4A shows a side view of two coil key separator devices installed between the coils of a heat exchanger for a swimming pool or spa;

FIG. 5A shows a partial section of two coils in one possible embodiment of a heat exchanger for a swimming pool;

FIG. 5B shows a top view of a heat exchanger for a swimming pool or spa and coil key separator devices installed therein;

FIG. 5C shows a side view of a heat exchanger for a swimming pool or spa and a coil key separator device installed therein, as well as possible measurements and dimensions therefor;

FIGS. 10 and 10A show two possible embodiments of a pool and a heating system for a pool; and FIGS. 11 and 11A show two possible embodiments of a pool and a heating system for a pool.

DESCRIPTION OF EMBODIMENT OR EMBODIMENTS

FIGS. 1, 1A, 10, 10A, 11, and 11A each show possible embodiments of a pool and a heating system for a pool. The pool is connected to the heating system via a series of water pipes. Water flows from the pool to the heating system, where it is heated. Once the water is heated, it flows back to the pool.

Figure 2:
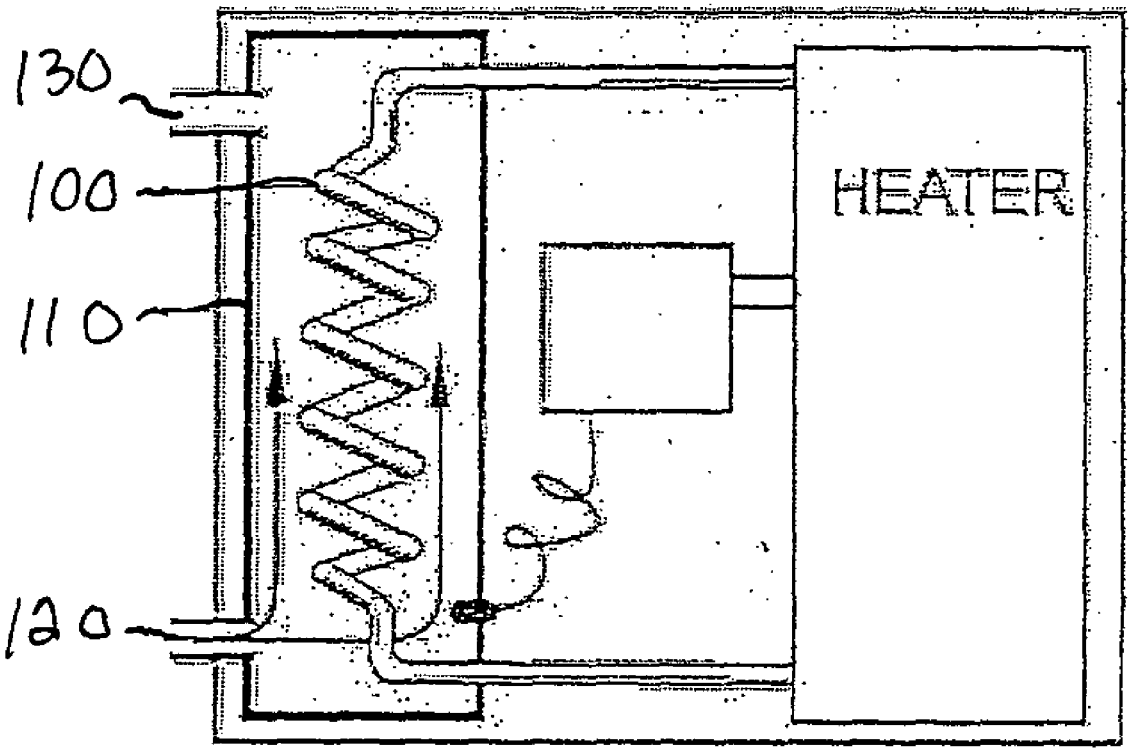
FIG. 2 is schematic drawing of a typical pool heater with a shell in tube heat exchanger pool shown having a simplified single coil configuration.
Figure 3:
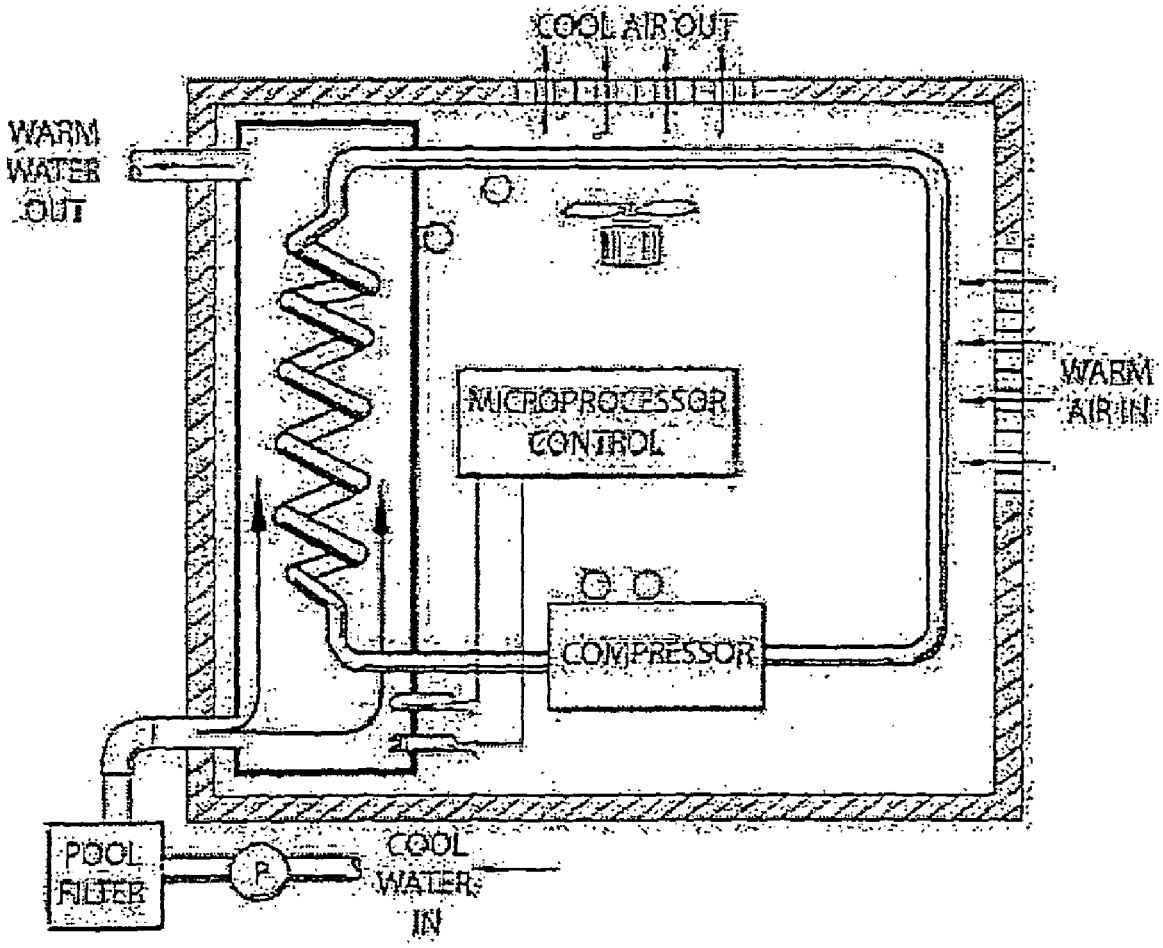
FIG. 3 shows a possible embodiment of a heating system for a pool.

FIG. 2 is schematic drawing of a typical pool heater with a shell in tube heat exchanger pool shown having a simplified single coil configuration. The pool heater comprises a coil 100 for carrying a heating agent, a housing 110 for containing water within the pool heater, and a water inlet 120 that is designed to permit water to flow into the pool heater. Once water is heated, it flows out through the water outlet 130. FIG. 3 shows another possible embodiment of a pool heating system.

According to one possible embodiment, as shown in FIGS. 4, 4A, 5A, 5B, 5C, 6 and 7, the heat exchanger 40 comprises an inner coil 30 and an outer coil 20, as well as a surrounding wall 5. There is a space 3 between the outer wall 5 and the outer coil 20, and a space 1 between the outer coil 20 and the inner coil 30. In order to heat the water of a pool or spa, the inner coil 30 and the outer coil 20 carry a heating agent that has been heated by a heater. Water from a pool or spa is pumped into the heat exchanger 40 so that it flows between the inner and outer coils 30 and 20 and in the spaces 1 and 3 within the outer wall 5. The heating agent flowing through the inner coil 20 and the outer coil 30 transfer heat to the surrounding water in order to heat it. Heated water is then pumped out of the heat exchanger 40. It should be noted that the separator device 10 can also be used in a single-coil embodiment of a heat exchanger, or any other embodiment of heat exchanger where the rubbing of two tubes together must be prevented.

FIG. 4 shows an overhead view of a heat exchanger 40 and the positioning of the separator devices 10 therein. In this embodiment, there are three separator devices 10 installed in the heat exchanger 40. However, in other possible embodiments, more separator devices 10 or less separator devices 10 may possibly be used to separate the coils of the heat exchanger 40. FIG. 4 shows 3 separator devices 10 evenly spaced around the heat exchanger 40, at approximately 120 degrees apart from each other. This even spacing dampens the vibration of the coils and substantially prevents the outer coil 20 from vibrating against each other, the inner coil 30 from vibrating against each other, the outer coil 20 from vibrating against the surrounding wall 5, and substantially prevents the outer coil 20 from vibrating against the inner coil 30.

FIG. 4A shows a side view of two coil key separator devices installed between the coils of a heat exchanger for a swimming pool or spa. The inner portion 12 of the separator device 10 rests against the inner coil 30 of the heat exchanger 40. The curved middle portion 14 rests between an upper rung 50 and a lower rung 60 of the outer coil 20. In the locked position, the separator device 10 is positioned vertically, that is, the inner portion 12 and the outer portion 16 are disposed vertically when the separator device 10 is in the locked position.

Figure 5:
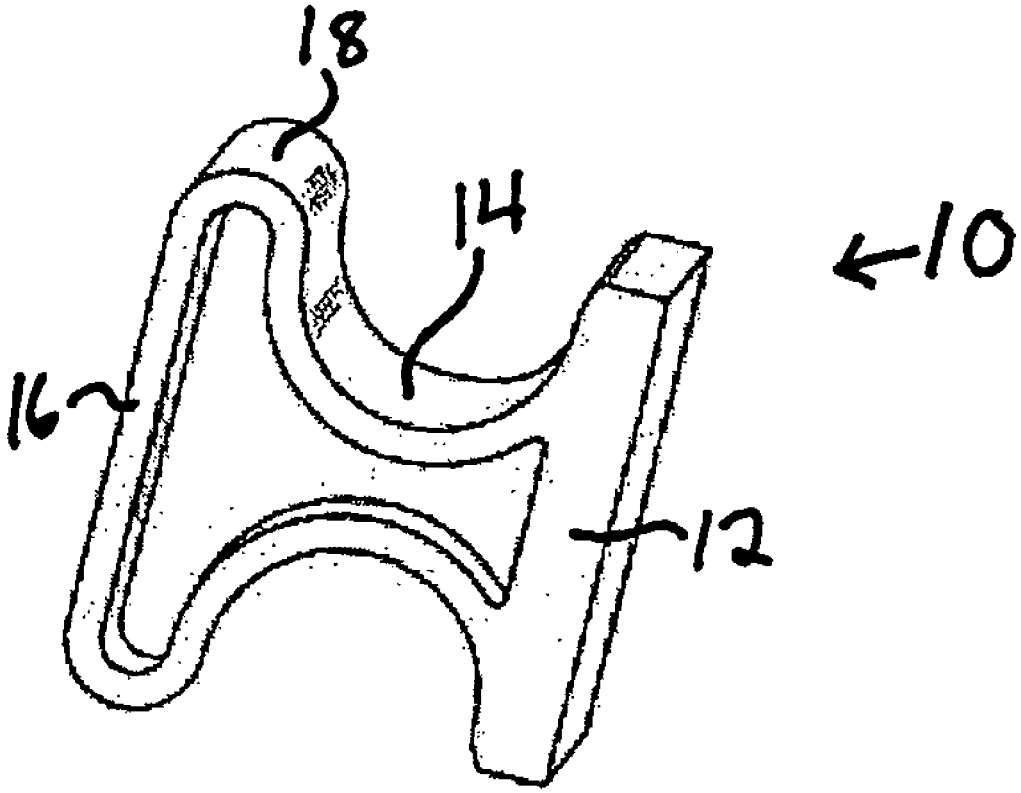
FIG. 5 shows a side perspective view of the coil key separator device.

FIG. 5 shows a perspective view of the separator device 10. The separator device 10 comprises an inner portion 12, a curved middle portion 14, and an outer portion 16. The outer portion 16 comprises rounded outer edges 18 that are easy to grip and twist the separator device 10 when it is being installed between the coils of a heat exchanger 40. The inner portion 12 is substantially flat, so that it may rest against the side of an inner coil 30 of the heat exchanger 40. The curved middle portion 14 is designed to rest between an upper and lower section of the outer coil 20 of the heat exchanger 40. It should be noted that the separator device 10 may have larger or smaller dimensions depending upon the size and shape of the heat exchanger in which it is being used.

FIGS. 5A, 5B, and 5C show a heat exchanger for a swimming pool or spa and coil key separator devices therefor, as well as possible measurements and dimensions therefor. It should be noted that the dimensions given in FIGS. 5B and 5C are only possible examples of one possible embodiment of a heat exchanger. Other possible embodiments of heat exchangers may be larger or smaller than the embodiment shown in FIGS. 5B and 5C. The measurements and dimensions shown in FIGS. 5B and 5C are not meant to limit the present application to the embodiment shown in any way.

Figure 6:
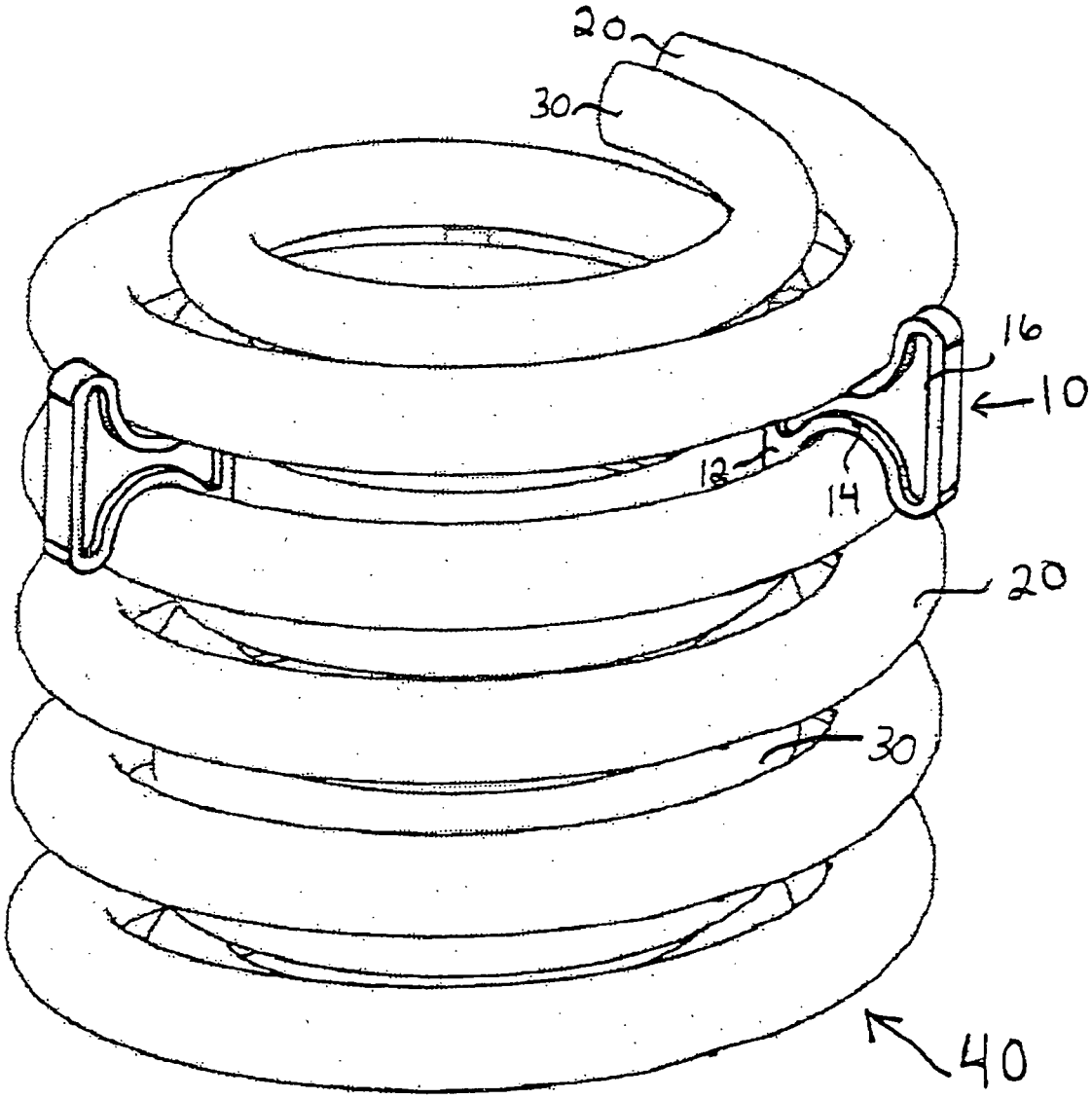
FIG. 6 shows the coil key separator device installed between the coils of a heat exchanger for a swimming pool or spa.

FIG. 6 shows the coil key separator device 10 installed between the coils of a heat exchanger 40 for a swimming pool or spa. The coil key separator device 10 is inserted between adjacent portions or sections of the outer coil 20, such that the outer portion 16 and the inner portion 12 of the coil key 10 are positioned longitudinally with respect to the adjacent sections of the outer coil during insertion. Once the inner portion 12 comes into contact with the inner coil 30 of the heat exchanger 40, the outer portion 16 of the separator device 10 is twisted clockwise or counterclockwise into a locked position, such that the curved middle portion 14 of the separator device 10 rests between the adjacent sections of the outer coil 20 of the heat exchanger 40, and the outer portion 16 and the inner portion 12 of the separator device 10 are disposed in a vertical position. In the locked position, the separator device 10 substantially prevents the outer coil 20 from vibrating against each other, the inner coil 30 from vibrating against each other, the outer coil 20 from vibrating against the surrounding wall 5, and it prevents the outer coil 20 from vibrating against the inner coil 30.

Figure 7:
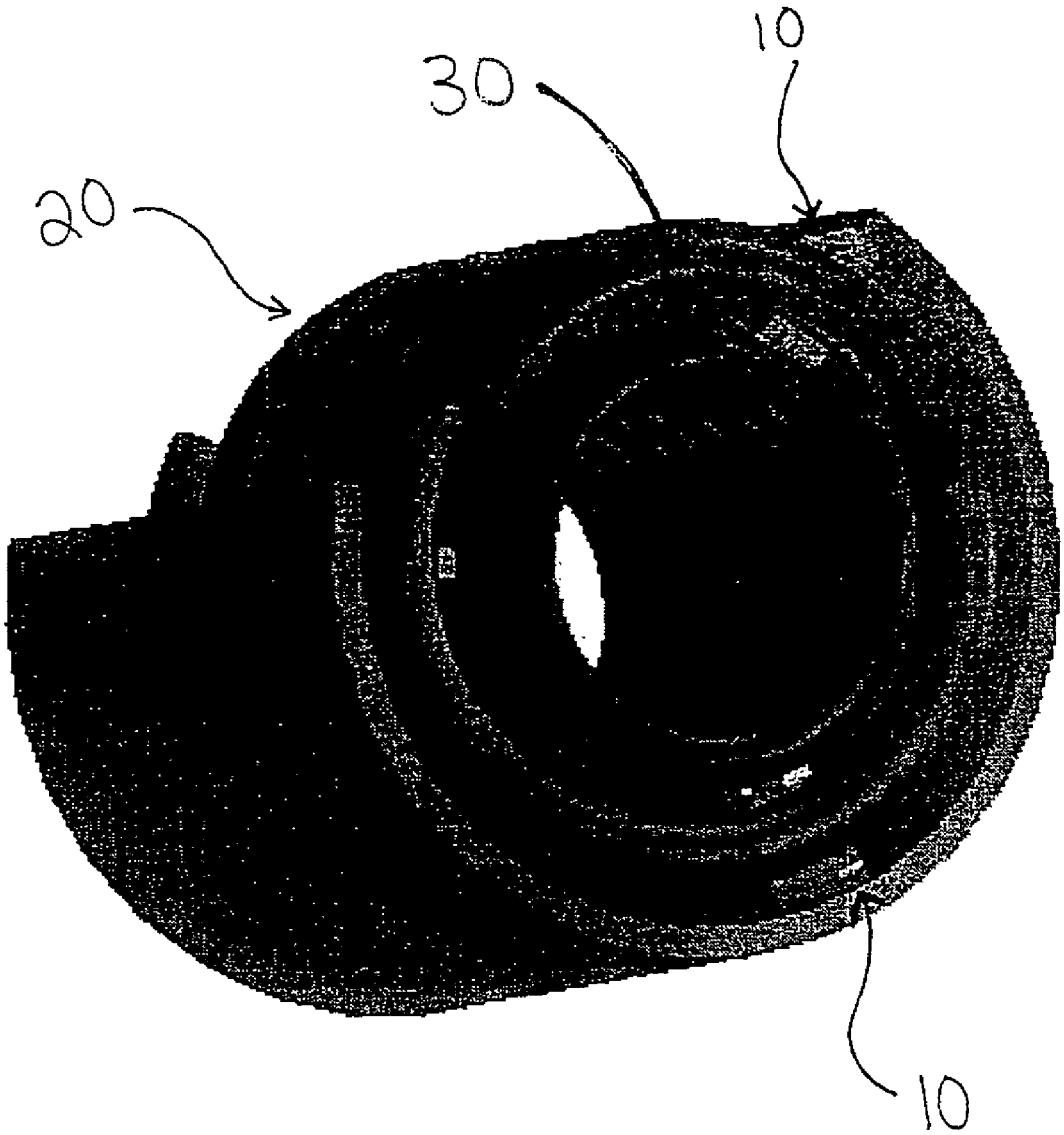
FIG. 7 is a 3-D perspective view of several coil key separator devices installed between the coils of a heat exchanger for a swimming pool or spa.

FIG. 7 is a 3-D perspective view of several coil key separator devices installed between the coils of a heat exchanger for a swimming pool or spa. The coil key separator device 10 is inserted between an upper ring and a lower ring of the outer coil 20, such that the outer portion 16 and the inner portion 12 are positioned longitudinally during insertion. Once the inner portion 12 comes into contact with the inner coil 30 of the heat exchanger 40, the outer portion 16 of the separator device 10 is twisted clockwise or counterclockwise into a locked position, such that the curved middle portion 14 of the separator device 10 rests between an upper and lower rung of the outer coil 20 of the heat exchanger 40, and the outer portion 16 and the inner portion 12 of the separator device 10 are disposed in a vertical position. In the locked position, the separator device 10 substantially prevents the outer coil 20 from vibrating against each other, the inner coil 30 from vibrating against each other, the outer coil 20 from vibrating against the surrounding wall 5, and substantially prevents the outer coil 20 from vibrating against the inner coil 30.

An example of a swimming pool or spa heating device, components of which may possibly be utilized or adapted for use in at least one possible embodiment, is the Heat Siphon swimming pool heat pump manufactured by United States Thermoamp Inc., located at 1223 Heat Siphon Lane, Latrobe, Pa. 15650.

Figure 8:
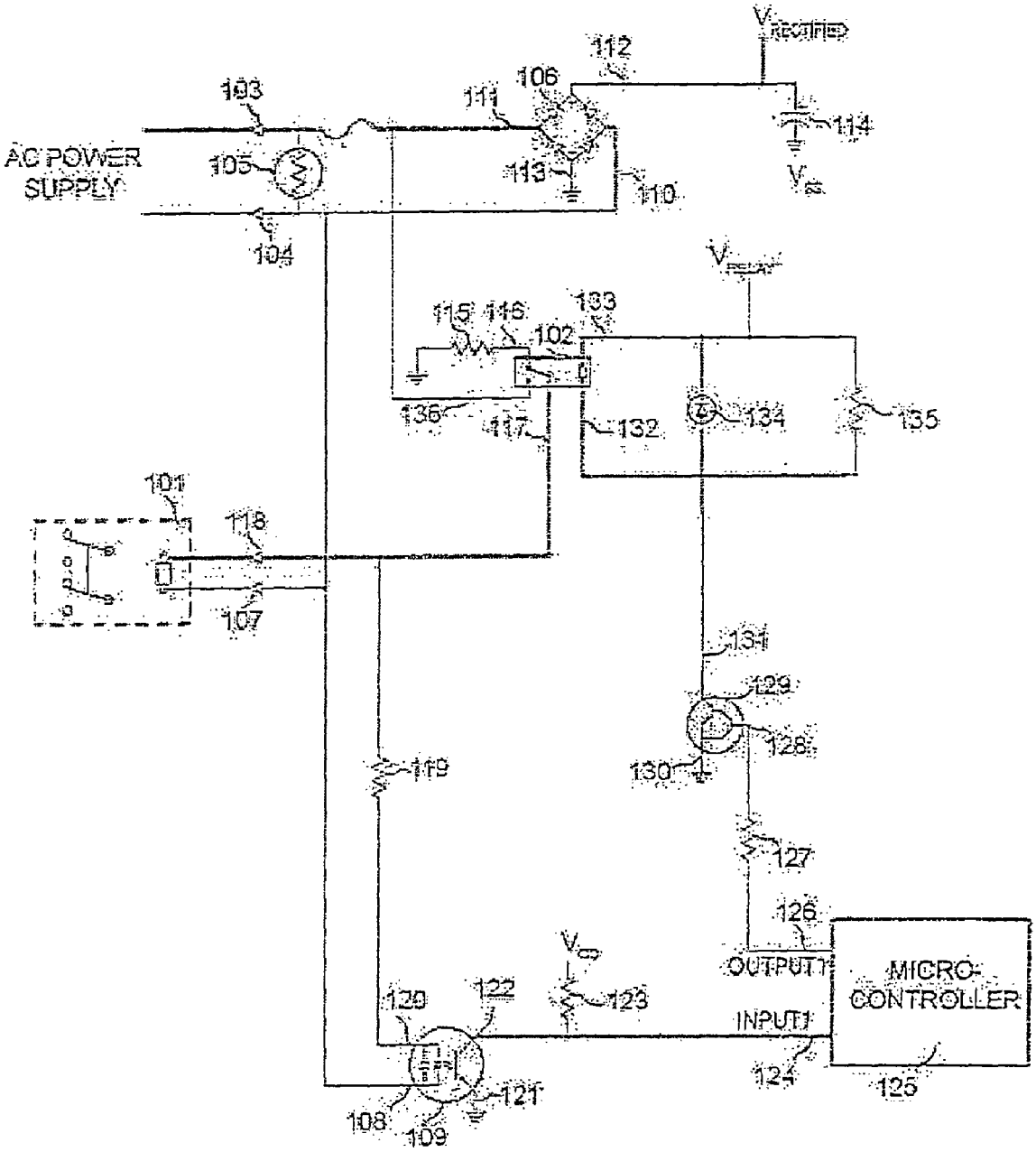
FIG. 8 shows a circuit for a possible embodiment of a heater or heat exchanger.
Figure 9:
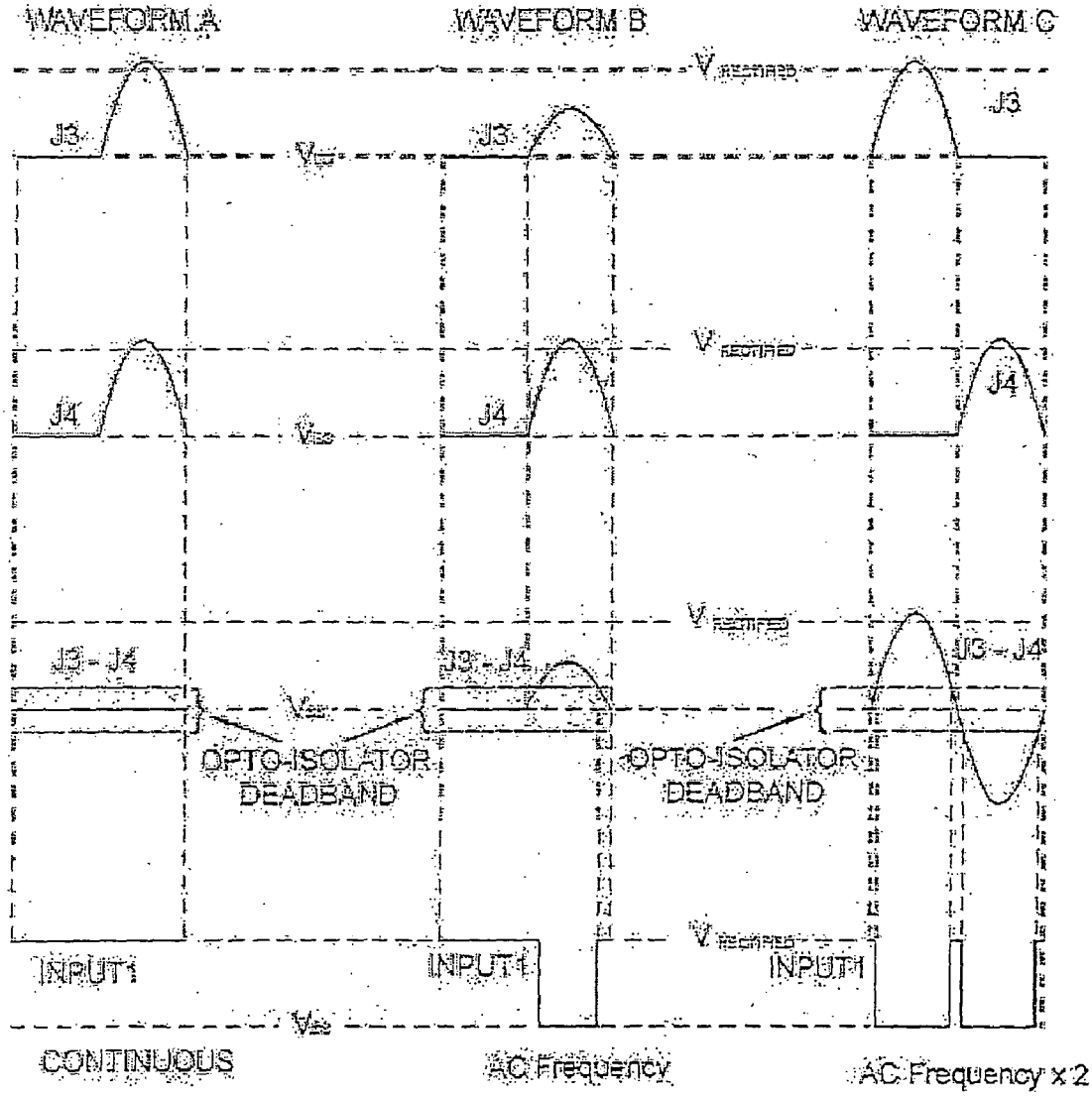
FIG. 9 shows a circuit for a possible embodiment of a heater or heat exchanger.

The following is a description of a possible embodiment of a heater or heat exchanger for a pool or spa, components of which may possibly be utilized or adapted for use in at least one possible embodiment. The following description describes FIGS. 8 and 9.

The purpose of this electrical circuit is to detect a connection to a power relay 101. A secondary function is to detect errors in the on-board control relay 102 that switches the voltage supply to the power relay 101.

The entire circuit is powered by an AC signal which is supplied through terminals 103 and 104. A metal oxide varistor 105 is used on the supply power to clip excessive voltages due to surges or lightning strikes. A thermal fuse is used on the line leg of the supply power to prevent a component failure from resulting in further damage. The fused line leg is multiplexed to the normally open contact of the on-board control relay 102 and to the diode bridge 106. The neutral leg of the supply power is multiplexed to the neutral terminal of the power relay terminal 107, the secondary side pin 108 of the opto-isolator 109, and to pin 110 of the diode bridge 106.

The diode bridge 106 rectifies the AC signal supplied on pins 110 and 111 into a DC signal with positive $V_{RECTIFIED}$ on pin 112 and negative $V_{SS}$ on pin 113. The bypass capacitor 114 provides for a stable DC voltage. $V_{SS}$ is supplied to one side of buffer resistor 115 while the other side of the resistor 115 is connected to the normally closed contact pin 116 of the on-board control relay 102. The common contact 117 of the on-board control relay 102 is multiplexed to the line terminal of the power relay 118 and to one side of the voltage drop resistor 119. The other side of the voltage drop resistor 119 is connected to pin 120 the primary side of the opto-isolator 109.

Pin 121 of the opto-isolator 109 is tied to $V_{SS}$ while pin 122 is pulled high to $V_{CC}$ through a pull-up resistor 123. Pin 122 of the opto-isolator 109 is also connected to the INPUT1 pin 124 of the microcontroller 125. The OUTPUT1 pin 126 of the microcontroller 125 is connected to buffer resistor 127 which, in turn, is connected to the drive pin 128 of the darlington transistor 129. Pin 130 of the darlington transistor 129 is tied to $V_{SS}$, while pin 131 of the darlington transistor 129 is connected to pin 132 of the on-board control relay 102. Pin 133 of the on-board control relay 102 is tied to $V_{RELAY}$ which is the DC control voltage. Blocking diode 134 and bleed resistor 135 are connected in parallel with pins 132 and 133 of the on-board control relay 102 to provide additional protection for the on-board control relay 102.

Two switch positions of the on-board control relay 102 are possible: common pin 117 connected to normally closed pin 117 and common pin 136 connected to normally open. The power relay 101 can either be attached to connectors 107 and 118 or disconnected from one or both of these connectors resulting in an open circuit. There are 4 possible combinations of these conditions.

For combination 1, the Relay 102 Contacts are 117 to 116, the Relay 101 Coil State is Connected, the PIN 118 Signal is AC (Neutral), the PIN 107 Signal is AC (Neutral), and the INPUT1 PIN 124 is Waveform A; for combination 2, the Relay 102 Contacts are 117 to 116, the Relay 101 Coil State is Open, the PIN 118 Signal is See Waveform B, the PIN 107 Signal is AC (Neutral), and the INPUT1 PIN 124 is Waveform B; for combination 3, the Relay 102 Contacts are 117 to 136, the Relay 101 Coil State is Connected, the PIN 118 Signal is AC (Line), the PIN 107 Signal is AC (Neutral), and the INPUT1 PIN 124 is Waveform C; and for combination 4, the Relay 102 Contacts are 117 to 136, the Relay 101 Coil State is Open, the PIN 118 Signal is AC (Line), the PIN 107 Signal is AC (Neutral), and the INPUT1 PIN 124 is Waveform C.

Combination 1: In combination 1, the on-board control relay 102 connects the common pin 117 to normally closed pin 116. Power relay 102 coil is connected to pin 118 and pin 107. The resistance of the control side of the power relay 101 is significantly less than the value of the buffer resistor 115 which forces the buffer resistor 115 to drop the majority of the voltage between $V_{SS}$ and AC neutral. As a result, the voltage differential between pins 108 and 120 of opto-isolator 109 is not sufficient to energize the opto-isolator 109 circuit. The opto-isolator circuit is not energized, which results in the INPUT1 pin 124 of the micro-controller 125 maintaining a constant state of $V_{CC}$ (Waveform A).

Combination 2: In combination 2, the on-board control relay 102 connects the common 117 to normally closed pin 116. Power relay 102 coil is an open circuit and therefore creating an open circuit between pin 118 and pin 107. AC neutral is present on pin 107. Due to the open circuit between 107 and 118, there exists a voltage divider between $V_{SS}$ and AC neutral across resistors 115 and 119. The voltage differential between pin 107 and pin 117 results in a pulsed turn-on of the opto-isolator 109 and Waveform B on the INPUT1 pin 124 of the micro-controller 125.

Combinations 3 & 4: In combinations 3 and 4, the on-board control relay 102 connects the common pin 117 to normally open pin 136. AC neutral is present on connector 107 and AC line is present on connector 118. Because the normally open pin 136 does not have a buffer resistor, the voltage on connector 118 is not affected by the presence of power relay 101. The voltage differential between 118 and 107 results in a pulsed turn-on of the opto-isolator 109 and Waveform C on the INPUT1 pin 124 of the micro-controller 125. The waveform on INPUT1 pin 124 is completely determined by the relay combination. The presence of Waveform A establishes that the power relay 101 is connected and that the on-board relay 102 is in the de-energized (normal) position. The presence of Waveform B establishes that the power relay 101 is not connected and that the on-board relay 102 is in the de-energized (normal) position. The presence of Waveform C establishes that the on-board relay 102 is in the energized position, but provides no information about the presence of the power relay 101.

Two voltage states are possible on the OUTPUT1 pin 126 of the microcontroller 125: $V_{SS}$ and $V_{CC}$. These two states in combination with the 4 relay combinations listed above result in 8 cases as tabulated in Table 2.

TABLE 2

| Case | OUTPUT1 Pin 126 | Combination | INPUT1 Pin 124 |
|---|---|---|---|
| 1 | VSS | 1 | Waveform A |
| 2 | VSS | 2 | Waveform B |
| 3 | VSS | 3 | Waveform C |
| 4 | VSS | 4 | Waveform C |
| 5 | VCC | 1 | Waveform A |
| 6 | VCC | 2 | Waveform B |
| 7 | VCC | 3 | Waveform C |
| 8 | VCC | 4 | Waveform C |

The presence of $V_{SS}$ on the OUTPUT1 pin 124 of the micro-controller 125 should place the on-board control relay 102 in the normal (de-energized) position. The presence of waveform A indicates that the power relay 101 is properly connected. The presence of waveform B indicates that the power relay 101 is not connected. The presence of waveform C (combination 3 or 4), which indicates the energized position, directly indicates that the on-board control relay 102 has mal-functioned. Thus, before the microcontroller 125 energizes the OUTPUT1 pin 126 to $V_{CC}$, the power relay 101 can be detected.

The presence of $V_{CC}$ on the OUTPUT1 pin 126 of the micro-controller 125 should place the on-board control relay 102 in the energized position. The presence of waveforms A or B indicates that the on-board control relay 102 is in the de-energized position, and that the on-board control relay 102 is malfunctioning. The presence of waveform C (combination 3 or 4) indicates that the on-board control relay 102 is operating properly, but provides no information about the power relay 101.

The resulting Logic is that if the microcontroller 125 has not energized the OUTPUT1 pin 126, waveform C indicates an on-board control relay 102 error. Waveform A indicates the presence of power relay 101 while Waveform B indicates the absence of power relay 101.

If the microcontroller 125 has energized the OUTPUT1 pin 126, waveforms A and B indicate an on-board control relay 102 error.

The components disclosed in the various publications, disclosed or incorporated by reference herein, may possibly be used in possible embodiments of the present invention, as well as equivalents thereof.

The purpose of the statements about the technical field is generally to enable the Patent and Trademark Office and the public to determine quickly, from a cursory inspection, the nature of this patent application. The description of the technical field is believed, at the time of the filing of this patent application, to adequately describe the technical field of this patent application. However, the description of the technical field may not be completely applicable to the claims as originally filed in this patent application, as amended during prosecution of this patent application, and as ultimately allowed in any patent issuing from this patent application. Therefore, any statements made relating to the technical field are not intended to limit the claims in any manner and should not be interpreted as limiting the claims in any manner.

Some examples of heat exchangers for swimming pools or spas which may possibly be utilized or adapted for use in at least one possible embodiment may possibly be found in the following U.S. patents: U.S. Pat. No. 6,789,615, entitled "Heat exchanger, in particular for swimming pools;" U.S. Pat. No. 4,733,417, entitled "Steady state swimming pool heat exchanger;" U.S. Pat. No. 4,567,942, entitled "Shell and tube falling film heat exchanger with tubes in concentric rings and liquid distribution box;" U.S. Pat. No. 4,455,227, entitled "Combination filter heat exchanger;" U.S. Pat. No. 5,487,423, entitled "Heat exchanger;" U.S. Pat. No. 5,901,563, entitled "Heat exchanger for heat transfer system."

The appended drawings in their entirety, including all dimensions, proportions and/or shapes in at least one embodiment of the invention, are accurate and are hereby included by reference into this specification.

The background information is believed, at the time of the filing of this patent application, to adequately provide background information for this patent application. However, the background information may not be completely applicable to the claims as originally filed in this patent application, as amended during prosecution of this patent application, and as ultimately allowed in any patent issuing from this patent application. Therefore, any statements made relating to the background information are not intended to limit the claims in any manner and should not be interpreted as limiting the claims in any manner.

Some examples of pool pumps, components of which may possibly be utilized or adapted for use in at least one possible embodiment, may possibly be found in the following U.S. patents: U.S. Pat. No. 4,279,128, entitled "Heat pump swimming pool heater;" U.S. Pat. No. 6,659,717, entitled "Filter pump for a pool;" U.S. Pat. No. 5,278,455, entitled "Spa and pool pump and heater control;" U.S. Pat. No. 4,842,054, entitled "Pump/heat exchanger assembly for pool-type reactor;" U.S. Pat. No. 4,279,128, entitled "Heat pump swimming pool heater;" U.S. Pat. No. 4,892,464, entitled "Pump means for swimming pools and similar facilities."

All, or substantially all, of the components and methods of the various embodiments may be used with at least one embodiment or all of the embodiments, if more than one embodiment is described herein.

The purpose of the statements about the object or objects is generally to enable the Patent and Trademark Office and the public to determine quickly, from a cursory inspection, the nature of this patent application. The description of the object or objects is believed, at the time of the filing of this patent application, to adequately describe the object or objects of this patent application. However, the description of the object or objects may not be completely applicable to the claims as originally filed in this patent application, as amended during prosecution of this patent application, and as ultimately allowed in any patent issuing from this patent application. Therefore, any statements made relating to the object or objects are not intended to limit the claims in any manner and should not be interpreted as limiting the claims in any manner.

All of the patents, patent applications and publications recited herein, and in the Declaration attached hereto, are hereby incorporated by reference as if set forth in their entirety herein.

The summary is believed, at the time of the filing of this patent application, to adequately summarize this patent application. However, portions or all of the information contained in the summary may not be completely applicable to the claims as originally filed in this patent application, as amended during prosecution of this patent application, and as ultimately allowed in any patent issuing from this patent application. Therefore, any statements made relating to the summary are not intended to limit the claims in any manner and should not be interpreted as limiting the claims in any manner.

It will be understood that the examples of patents, published patent applications, and other documents which are included in this application and which are referred to in paragraphs which state "Some examples of . . . which may possibly be used in at least one possible embodiment of the present application . . . " may possibly not be used or useable in any one or more embodiments of the application.

The sentence immediately above relates to patents, published patent applications and other documents either incorporated by reference or not incorporated by reference.

All of the references and documents, cited in any of the documents cited herein, are hereby incorporated by reference as if set forth in their entirety herein. All of the documents cited herein, referred to in the immediately preceding sentence, include all of the patents, patent applications and publications cited anywhere in the present application.

The description of the embodiment or embodiments is believed, at the time of the filing of this patent application, to adequately describe the embodiment or embodiments of this patent application. However, portions of the description of the embodiment or embodiments may not be completely applicable to the claims as originally filed in this patent application, as amended during prosecution of this patent application, and as ultimately allowed in any patent issuing from this patent application. Therefore, any statements made relating to the embodiment or embodiments are not intended to limit the claims in any manner and should not be interpreted as limiting the claims in any manner.

The details in the patents, patent applications and publications may be considered to be incorporable, at applicant's option, into the claims during prosecution as further limitations in the claims to patentably distinguish any amended claims from any applied prior art.

The purpose of the title of this patent application is generally to enable the Patent and Trademark Office and the public to determine quickly, from a cursory inspection, the nature of this patent application. The title is believed, at the time of the filing of this patent application, to adequately reflect the general nature of this patent application. However, the title may not be completely applicable to the technical field, the object or objects, the summary, the description of the embodiment or embodiments, and the claims as originally filed in this patent application, as amended during prosecution of this patent application, and as ultimately allowed in any patent issuing from this patent application. Therefore, the title is not intended to limit the claims in any manner and should not be interpreted as limiting the claims in any manner.

The abstract of the disclosure is submitted herewith as required by 37 C.F.R. §1.72(b). As stated in 37 C.F.R. §1.72 (b):

> A brief abstract of the technical disclosure in the specification must commence on a separate sheet, preferably following the claims, under the heading "Abstract of the Disclosure." The purpose of the abstract is to enable the Patent and Trademark Office and the public generally to determine quickly from a cursory inspection the nature and gist of the technical disclosure. The abstract shall not be used for interpreting the scope of the claims.

Therefore, any statements made relating to the abstract are not intended to limit the claims in any manner and should not be interpreted as limiting the claims in any manner.

The embodiments of the invention described herein above in the context of the preferred embodiments are not to be taken as limiting the embodiments of the invention to all of the provided details thereof, since modifications and variations thereof may be made without departing from the spirit and scope of the embodiments of the invention.

What is claimed is:

1. A method of increasing the life of components of a swimming pool or spa or combination swimming pool and spa, and of reducing wear of components of a swimming pool or spa or combination swimming pool and spa, said swimming pool or spa or combination swimming pool and spa comprising: a recreational structure being configured to hold water for recreational purposes and to permit users to immerse themselves in water; a heat exchanger being configured and disposed to heat water from said swimming pool or spa or combination swimming pool and spa; a heater being configured and disposed to heat a heating agent in said heat exchanger; a water pump being configured and disposed to circulate water in said swimming pool or spa or combination swimming pool and spa, and in said heat exchanger; a connecting device being configured and disposed to connect said pump to said recreational structure; a temperature sensor being configured and disposed to sense the temperature of water to be heated; said heat exchanger comprising: a heating agent pump being configured to pump a heating agent into said heat exchanger; a water input for permitting the flow of water into said heat exchanger; a heating agent input for permitting the flow of heating agent into said heat exchanger; a water output for permitting the flow of water out of said heat exchanger; a heating agent output for permitting the flow of heating agent out of said heat exchanger; a heater being configured to heat a heating agent to be circulated through said heat exchanger; an inner coil being configured and disposed to carry a heating agent; an outer coil being disposed about the outer periphery of said inner coil; said outer coil being configured and disposed to carry a heating agent; an outer wall being disposed about the periphery of said outer coil and being disposed to house said inner coil and said outer coil; a first space between said wall and said outer coil; a second space between said outer coil and said inner coil; said first space and said second space being configured and disposed to hold water to be heated by said inner coil and said outer coil; said inner coil and said outer coil being configured and disposed to heat water from a swimming pool or spa; a separator device being configured and disposed to separate said coils of said heat exchanger in order to minimize said coils from vibrating and rubbing against each other, said separator device comprising: a first separator device portion comprising a flat end surface; said first separator device portion having an adequate length to span a substantial portion of a first coil portion and a substantial portion of a second coil portion adjacent to said first coil portion of said inner coil and said outer coil; said first separator device portion comprising two rounded shoulder portions, which rounded shoulder portions are disposed opposite said flat end surface; said rounded shoulder portions being configured to permit said separator device to be rotated into position between said inner coil and said outer coil, and to substantially prevent the inner side of said outer coil from blocking the rotation of said separator device upon the installation of said separator device; a middle portion comprising two substantially C-shaped curves, which substantially C-shaped curves form a dog bone-shape; a second separator device portion comprising two rounded ends being configured to be turned or twisted upon assembly of said heat exchanger; said separator device, upon assembly of said heat exchanger, being configured to be inserted longitudinally between a first portion and a second portion disposed adjacent said first portion of said outer coil, until said first separator device portion of said separator device comes into contact with said inner coil; said separator device, upon coming into contact with said inner coil during assembly of said heat exchanger, being configured to be twisted clockwise or counter clockwise until said curved middle portion rests between a first portion and a second portion disposed adjacent said first portion of said outer coil, and wherein said first separator device portion and said second separator device portion of said separator device are disposed vertically; said method comprising the steps of:

determining by experimentation the number of separator devices needed in said heat exchanger, depending upon the size of said heat exchanger, whether said heat exchanger is for a swimming pool or spa or combination swimming pool and spa, the amount of water flowing through the heat exchanger, among other factors;

holding said separator device in a position with the hand of a user;

longitudinally inserting said separator device between a first coil section of said outer coil and a second coil section of said outer coil, said first coil section being disposed adjacent said second coil section;

stopping the insertion of said separator device upon said first separator device portion coming into contact with said inner coil;

twisting said separator device clockwise or counter clockwise until said curved middle portion rests between said first coil section and said second coil section of said outer coil, and until said first separator device portion and said second separator device portion of said separator device are disposed vertically with relation to said outer coil;

inserting additional separator devices into said outer coil at an even distance from each other about the circumference of said outer coil to minimize contact between said inner coil and said outer coil, thereby reducing wear of the components of said heat exchanger during use;

installing said heat exchanger into a swimming pool, spa, or combination swimming pool and spa system;

turning on the power of said heat exchanger and said water pump and said heat exchanger pump;

pumping water with said water pump from said recreational structure to said heat exchanger;

pumping a heating agent with said heating agent pump into said heat exchanger;

sensing the temperature of water within said heat exchanger with said temperature sensor;

heating water with said heat exchanger while minimizing contact and vibration between said inner coil and said outer coil with said separator devices;

pumping heated water with said water pump from said heat exchanger to said recreational structure;

swimming, splashing, and playing in said recreational structure configured to hold water for recreational purposes.

2. The method of increasing the life of components of a swimming pool or spa or combination pool and spa according to claim 1, wherein three of said separator devices are installed about the circumference of said outer coil at approximately 120 degrees from each other.

3. The method of increasing the life of components of a swimming pool or spa or combination swimming pool and spa according to claim 2, wherein said separator device is injection molded from a soft or hard suitable plastic material.

4. The method of increasing the life of components of a swimming pool or spa or combination swimming pool and spa according to claim 3, wherein said separator device has an approximate length of 1.125 inches, an approximate width of 1.238 inches, and an approximate thickness of 0.236 inches.

5. The method of increasing the life of components of a swimming pool or spa or combination swimming pool and spa according to claim 4, wherein said separator devices are installed between a plurality of adjacent sections of said outer coil.

6. The method of increasing the life of components of a swimming pool or spa or combination swimming pool and spa according to claim 5, wherein said separator devices are installed between adjacent sections of said inner coil.

7. A swimming pool or spa or combination swimming pool and spa, comprising:

a recreational structure being configured to hold water for recreational purposes, and to permit users to immerse themselves in water;

a pump being configured and disposed to circulate water in said swimming pool or spa or combination swimming pool and spa, and in said heat exchanger;

a connecting device being configured and disposed to connect said pump to said recreational structure;

a heat exchanger being configured and disposed to heat water from said swimming pool or spa or combination swimming pool and spa;

a heater being configured and disposed to heat a heating agent to be used in said heat exchanger;

said heat exchanger comprising:

a water input for permitting the flow of water from said recreational structure into said heat exchanger;

a heating agent input for permitting the flow of heating agent into said heat exchanger;

a water output for permitting the flow of water out of said heat exchanger and back to said recreational structure;

a heating agent output for permitting the flow of heating agent out of said heat exchanger;

an inner coil being configured and disposed to carry a heating agent;

an outer coil being disposed about the outer periphery of said inner coil;

said outer coil being configured and disposed to carry a heating agent;

an outer wall being disposed about the periphery of said outer coil and being disposed to house said inner coil and said outer coil;

a first space between said wall and said outer coil;

a second space between said outer coil and said inner coil;

said first space and said second space being configured and disposed to hold water to be heated by said inner coil and said outer coil;

said inner coil and said outer coil being configured and disposed to heat water from a swimming pool or spa or combination swimming pool and spa;

a separator device being configured and disposed to separate said coils of said heat exchanger in order to minimize said coils from vibrating and rubbing against each other, said separator device comprising:

a first separator device portion comprising a flat end surface;

said first separator device portion having an adequate length to span from the top of a first coil portion to the bottom of a second coil portion adjacent to said first coil portion of said inner coil and said outer coil;

said first separator device portion comprising two rounded shoulder portions, which rounded shoulder portions are disposed opposite said flat end surface;

said rounded shoulder portions being configured to permit said separator device to be rotated into position between said inner coil and said outer coil, and to substantially prevent the inner side of said outer coil from blocking the rotation of said separator device upon the installation of said separator device;

a middle portion comprising two substantially C-shaped curves, which substantially C-shaped curves form a dog bone-shape;

a second separator device portion comprising two rounded ends being configured to be turned or twisted upon assembly of said heat exchanger;

said separator device, upon assembly of said heat exchanger, being connected between a coil of outer coil structure and inner coil structure first ring and a second adjacent ring of said outer coil until said first separator device portion of said separator device comes into contact with said inner coil;

said separator device, upon coming into contact with said inner coil during assembly of said heat exchanger, being configured to be twisted clockwise or counter clockwise until said curved middle portion rests between a first portion and a second portion disposed adjacent said first portion of said outer coil, and wherein said first separator device portion and said second separator device portion of said separator device are disposed vertically.

8. The swimming pool or spa or combination swimming pool and spa according to claim 7, wherein three of said separator devices are installed about the circumference of said outer coil at approximately 120 degrees from each other.

9. The swimming pool or spa or combination swimming pool and spa according to claim 8, wherein said separator device is injection molded from a soft or hard suitable plastic material.

10. The swimming pool or spa or combination swimming pool and spa according to claim 9, wherein said separator device has an approximate length of 1.125 inches, an approximate width of 1.238 inches, and an approximate thickness of 0.236 inches.

11. The swimming pool or spa or combination swimming pool and spa according to claim 10, wherein said separator devices are installed between a plurality of adjacent sections of said outer coil.

12. The swimming pool or spa or combination swimming pool and spa according to claim 11, wherein said separator devices are installed between adjacent sections of said inner coil.

13. A heat exchanger for a swimming pool or spa or combination swimming pool and spa, said heat exchanger for a swimming pool or spa or combination swimming pool and spa comprising:

a heater being configured and disposed to heat a heating agent to be used in said heat exchanger;

a temperature sensor being configured to sense the temperature of water within said heat exchanger;

a water input being configured to permit the flow of water into said heat exchanger;

a heating agent input being configured to permit the flow of heating agent into said heat exchanger;

a water output being configured to permit the flow of water out of said heat exchanger;

a heating agent output being configured to permit the flow of heating agent out of said heat exchanger;

an inner coil being configured and disposed to carry a heating agent;

an outer coil being disposed about the outer periphery of said inner coil;

said outer coil being configured and disposed to carry a heating agent;

said inner coil and said outer coil being configured and disposed to heat water from a swimming pool or spa;

an outer wall being disposed about the periphery of said outer coil and being disposed to house said inner coil and said outer coil;

at least one space disposed between said wall and said inner and outer coil;

said at least one space being configured and disposed to hold water to be heated by said inner coil and said outer coil;

a separator device being configured and disposed to separate said coils of said heat exchanger in order to minimize vibration of said coils and to minimize the rubbing of said coils against each other, said separator device comprising:

a first separator device portion comprising a flat end surface;

said first separator device portion having an adequate length to span a substantial portion of a first coil portion and a second coil portion disposed adjacent to said first coil portion of said inner coil and said outer coil;

said first separator device portion comprising two rounded shoulder portions, which rounded shoulder portions are disposed opposite said flat end surface;

said rounded shoulder portions being configured to permit said separator device to be rotated into position between said inner coil and said outer coil, and to substantially prevent the inner side of said outer coil from blocking the rotation of said separator device upon the installation of said separator device;

a middle portion comprising two substantially C-shaped curves;

a second separator device portion comprising two rounded ends being configured to be turned or twisted upon assembly of said heat exchanger;

said separator device, upon assembly of said heat exchanger, being configured to be inserted longitudinally between two adjacent portions of said outer coil until said first separator device portion of said separator device comes into contact with said inner coil;

said separator device, upon coming into contact with said inner coil during assembly of said heat exchanger, being configured to be twisted clockwise or counter clockwise until said curved middle portion rests between two adjacent portions of said outer coil, and wherein said first separator device portion and said second separator device portion of said separator device are disposed vertically.

14. A method of using a heat exchanger in a swimming pool to increase the life of components of a swimming pool or spa or combination swimming pool and spa, and to reduce wear of components of a swimming pool or spa or combination swimming pool and spa according to claim 13, wherein said method comprises the steps of:

longitudinally inserting said separator device between a first coil section of said outer coil and a second coil section of said outer coil;

stopping the insertion of said separator device upon said first separator device portion coming into contact with said inner coil;

twisting said separator device clockwise or counter clockwise until said curved middle portion rests between two adjacent sections of said outer coil, and until said first separator device portion and said second separator device portion of said separator device are disposed vertically with relation to said outer coil;

installing said heat exchanger into a swimming pool, spa, or combination swimming pool and spa system;

operating said heat exchanger by pumping water through said heat exchanger;

heating water with said heat exchanger;

minimizing contact and vibration between said inner coil and said outer coil with said separator devices;

permitting flow of heated water out of said heat exchanger to said swimming pool or spa or combination swimming pool and spa.

15. The method of using a heat exchanger in a swimming pool to increase the life of components of a swimming pool or spa or combination swimming pool and spa according to claim 14, wherein three of said separator devices are installed about the circumference of said outer coil at approximately 120 degrees from each other.

16. The method of using a heat exchanger in a swimming pool to increase the life of components of a swimming pool or spa or combination swimming pool and spa according to claim 15, wherein said separator device is injection molded from a soft or hard suitable plastic material.

17. The method of using a heat exchanger in a swimming pool to increase the life of components of a swimming pool or spa or combination swimming pool and spa according to claim 16, wherein said separator device has an approximate length of 1.125 inches, an approximate width of 1.238 inches, and an approximate thickness of 0.236 inches.

18. The method of using a heat exchanger in a swimming pool to increase the life of components of a swimming pool or spa or combination swimming pool and spa according to claim 17, wherein said separator devices are installed between a plurality of adjacent sections of said outer coil.

19. The method of using a heat exchanger in a swimming pool to increase the life of components of a swimming pool or spa or combination swimming pool and spa according to claim 18, wherein said separator devices are installed between adjacent sections of said inner coil.

20. The method of using a heat exchanger in a swimming pool to increase the life of components of a swimming pool or spa or combination swimming pool and spa according to claim 19, wherein said separator device is configured to be installed in a single-coil heat exchanger.

* * * * *